United States Patent [19]

Gasser

[11] Patent Number: 4,615,048

[45] Date of Patent: Oct. 7, 1986

[54] HOLDER FOR PRE-KNOTTED NECKTIES

[76] Inventor: Arthur Gasser, Bungertweg 23, Dübendorf 8600, Switzerland

[21] Appl. No.: 724,003

[22] Filed: Apr. 17, 1985

[51] Int. Cl.[4] ..... A41D 25/08

[52] U.S. Cl. ..... 2/153

[58] Field of Search ..... 2/152 R, 137, 152 A, 2/153, 145

[56] References Cited

U.S. PATENT DOCUMENTS

| | | | |
|---|---|---|---|
| 3,365,726 | 1/1968 | Pulitzer | 2/153 |
| 3,964,105 | 6/1976 | Gideon | 2/152 R |
| 4,206,513 | 6/1980 | Collins | 2/152 R |

FOREIGN PATENT DOCUMENTS

| | | |
|---|---|---|
| 1913306 | 4/1965 | Austria . |
| 1956306 | 12/1966 | Austria . |
| 574070 | 7/1957 | Italy . |
| 490818 | 7/1970 | Switzerland . |

OTHER PUBLICATIONS

Copy of Description and Claims of Abandoned U.S. Application, Ser. No. 697,724, 11/20/57.

*Primary Examiner*—Werner H. Schroeder
*Assistant Examiner*—Andrew M. Falik
*Attorney, Agent, or Firm*—Ostrolenk, Faber, Gerb & Soffen

[57] ABSTRACT

A holder for pre-tied neckties. The necktie includes a slide fastener and two slide-fastener tapes to be joined by the slide fastener. Where the knot is to be formed, a knot supporting and shaping member is provided. A pair of plastic tubes extends up from the supporting and shaping member and another pair of tubes extends downwardly therefrom. A respective one of the upper and lower tubes together define a pathway for one of the slide-fastener tapes from above to below the supporting and shaping member. The plastic tubes extend towards the shaping member in approximately a V shape to define a X shape thereat. At least the upper plastic tubes may be covered with necktie material.

17 Claims, 8 Drawing Figures

HOLDER FOR PRE-KNOTTED NECKTIES

BACKGROUND OF THE INVENTION

The present invention relates to a holder for pre-knotted neckties, and particularly a holder which has a slide fastener or zipper of the known type. The holder includes an elongate tape with a loop in it which can be placed around the neck and can be adjusted by moving the slide of a slide fastener.

In known pre-knotted neckties of this type, the slide is rigidly connected with the front of the hollow holder. That holder consists of still material such as brass plate, etc. The slide fastener, which has metal, nylon or plastic teeth, consists of two tapes, which are not attached to the material of the neckties, and a slide movable for joining the sets of teeth on the two tapes. These tapes pass through the two small tubes of plastic, or the like, which are located in the necktie-knot holder and which extend in V shape to below the wearer's collar. At their upper ends, they are so connected to each other as to form a loop which can be placed around a wearer's neck.

In pre-knotted neckties of this type, the permanent attachment of the slide to the holder by soldering or riveting has a number of disadvantages.

For a wearer of a necktie who is in the habit of pulling somewhat on the necktie in order to bring the knot exactly into the center of the collar, as is customary in the case of a self-knotted necktie, this completely blocks the slide operation, as the slide cannot move away under pressure, since it is rigidly connected to the holder. If the wearer of the necktie wishes to actuate the release mechanism by pulling on the pull tab of the slide-fastener slide, in order to unlock the necktie from the collar by lengthening the loop, the slide cannot be opened. In order to eliminate this lock, it would have been sufficient to push the knot in the slide fastener a few millimeters further against the neck and then again pull on the tab. Unfortunately, many of these necktie wearers lose patience and cut the slide-fastener tape, so that the necktie is thereafter unusable. Due to its firm attachment to the holder, the slide also comes to lie too near to the knot, so that, in particular, wearers who have clumsy or large fingers have difficulty, particularly in the case of wider neckties with large knots, in finding the pull tab for the slide and in actuating the release mechanism.

The present invention eliminates these disadvantages. It does away with the rigid connection of the slide of the slide fastener or zipper to the holder. Now, blocking of the release mechanism is prevented, since the slide can now yield to any pressure caused by pulling on the neckties, etc. In this way, it also becomes possible for normal mass-produced slides of high quality to be used, and these are considerably cheaper to manufacture. Furthermore, the costly expense for soldering or riveting is avoided. Since there is now also less waste, a substantial saving can be obtained in the cost of manufacture, as well as in the warranty expenses.

In accordance with the invention, however, the slide lies outside the body of the knot. It is not firmly connected to the knot. Furthermore, one or both of the plastic tubes extends beyond the lower part of the holder and serves as an end stop for the slide-fastener slide in the upward direction toward the inside of the knot. The corresponding slide fastener also preferably consists only of a single left-hand or right-hand tape part of a nylon or plastic endless spiral slide-fastener or zipper. This part is passed from below up one side through the slide, through the tube present in the body of the knot, and then forms on top a loop, which is seamless. Then the part of the same tape on the other side is passed through the other tube present in the body of the knot, downward through the other side of the slide. The holder is supported by internal support against deformation and indentation.

By elimination of the soldering or riveting, instead of using electroplated or galvanized slides, it is possible to also use enameled or spray-lacquered slides and zippers, as well as slide-fastener tapes of different colors, which are adapted to the colors of the material of the neckties. A further improvement and a decrease in the cost of manufacture is obtained in using only one-half of an endless slide-fastener tape to form a loop and then to place it under the collar. This can be done instead of using a conventional metal or nylon two-part zipper slide fastener. In this way, the sewing together of the two individual slide-fastener tape halves to form a loop is avoided. Furthermore, the two starting parts as well as the end part of the slide fastener are no longer required. As a result, the wearer's collar will no longer be injured by the starting parts of metal. Upon manufacture, the possible elimination of damaged spiral slide-fastener tapes is less expensive than the removal of damaged conventional slide fasteners.

In previous slide-fastener neckties, disturbances in operation frequently occurred because the holder was squeezed upon the manufacture or by the wearer. This caused difficulties in connection with the passage of the tape or else caused damage to the tape. Furthermore, the shape and the appearance of the neckties suffered from the deformation. The present invention also eliminates this defect by the use of a so-called hollow, intermediate or support tube, through which the same spreader clamp, or the like, is passed that serves for connecting the plastic tubes and the necktie to the holder. Furthermore, the intermediate plastic tube assures that the thread connection between the necktie-material coverings of the two tubes extending out of the top of the knot are not cut or worn through by the spreader-clamp connection, or the like. In this way, the coverings can no longer come away from the tubes or out of the knot.

In order to prevent the slide from passing too deeply into the knot of the necktie and in order to obtain a lower position of the slide for the easier grasping of the pull tab, two additional downwardly extending plastic tubes are arranged in such a manner that they form an X together with the two previous upper, upwardly extending plastic tubes. Alternatively, the two previous plastic tubes are extended, in parallel to each other or diagonally downward, so that they protrude definitely below the holder and thus form an upper stop against the inside of the body of the knot to block the slide-fastener slide. The slide now comes to lie completely below the outside of the holder. Furthermore, better guidance of the slide-fastener tape or tapes is obtained.

For a person who wears a pre-knotted necktie, it is important that no difference can be noted from a selftied necktie in the nature or shape of the knot. In previous neckties of this type, the shape of the knot frequently was undesirable and gave evidence that the necktie was not self-knotted. This problem is also eliminated in the present invention in that the shaped body of the sponge rubber, plastic, or the like, which is placed on the shaping member now has a V or trapezoidal shape.

SUMMARY OF THE INVENTION

A holder for pre-tied neckties includes a slide fastener and corresponding slide-fastener tapes which are joined by the slide fastener. A supporting and shaping member for the necktie knot is connected by a clamp to two plastic tubes which extend in approximately a V shape toward said member. The slide fastener tapes are supported in each of the tubes. The slide is arranged to lie outside the body of the knot and thus not being connected thereto, is freely movable with respect to the supporting and shaping member. This is accomplished by extending the tubes sufficiently downwards so that the slide can be moved to a position below the shaping member.

Various embodiments of the invention are explained below with reference to the drawings.

DESCRIPTION OF THE PREFERRED EMBODIMENTS

Figure 1:
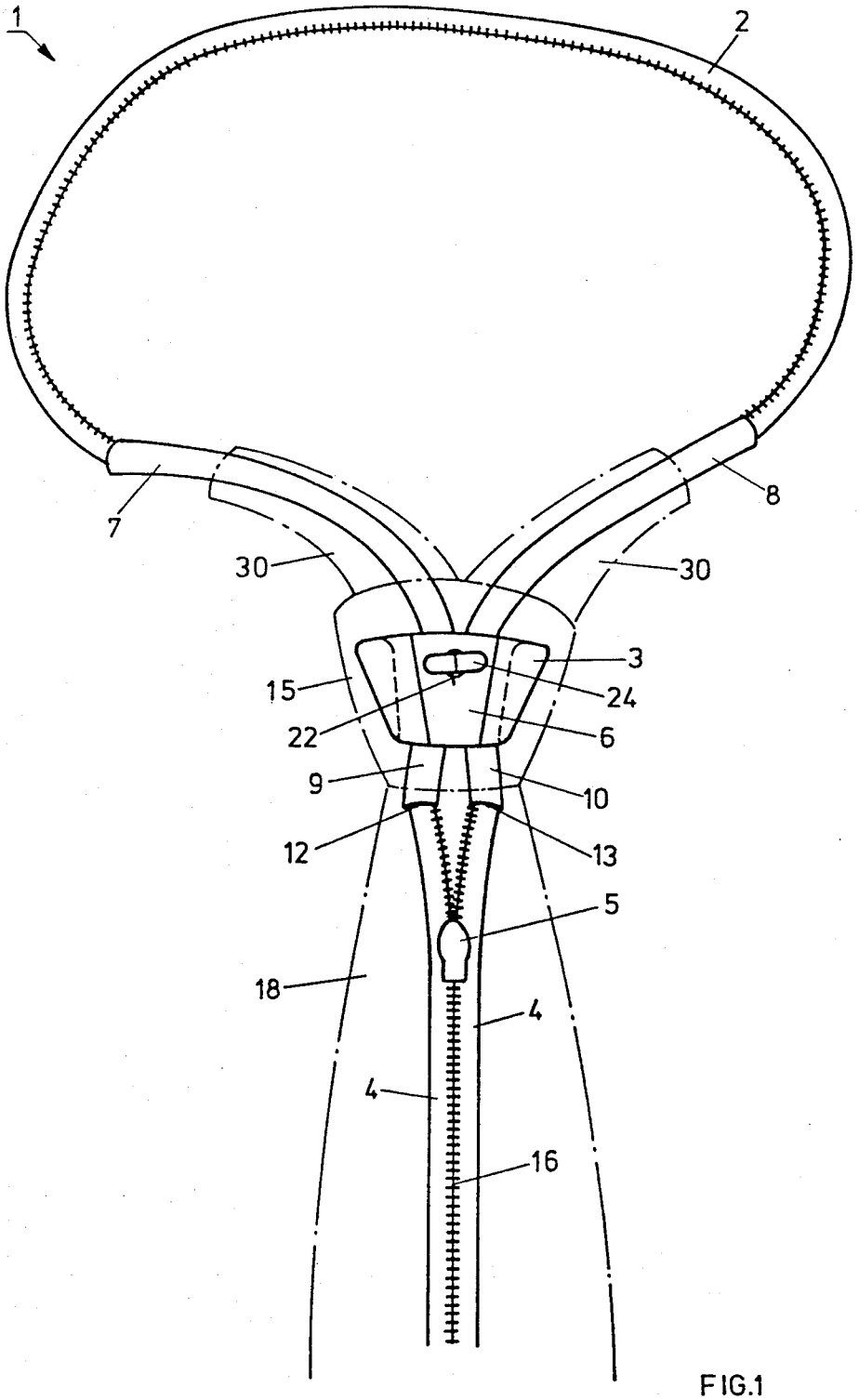
FIG. 1 is a front view of a necktie holder with neck loop partially pulled out and a necktie, indicated in dash-dot line, looped on the holder.
Figure 2:
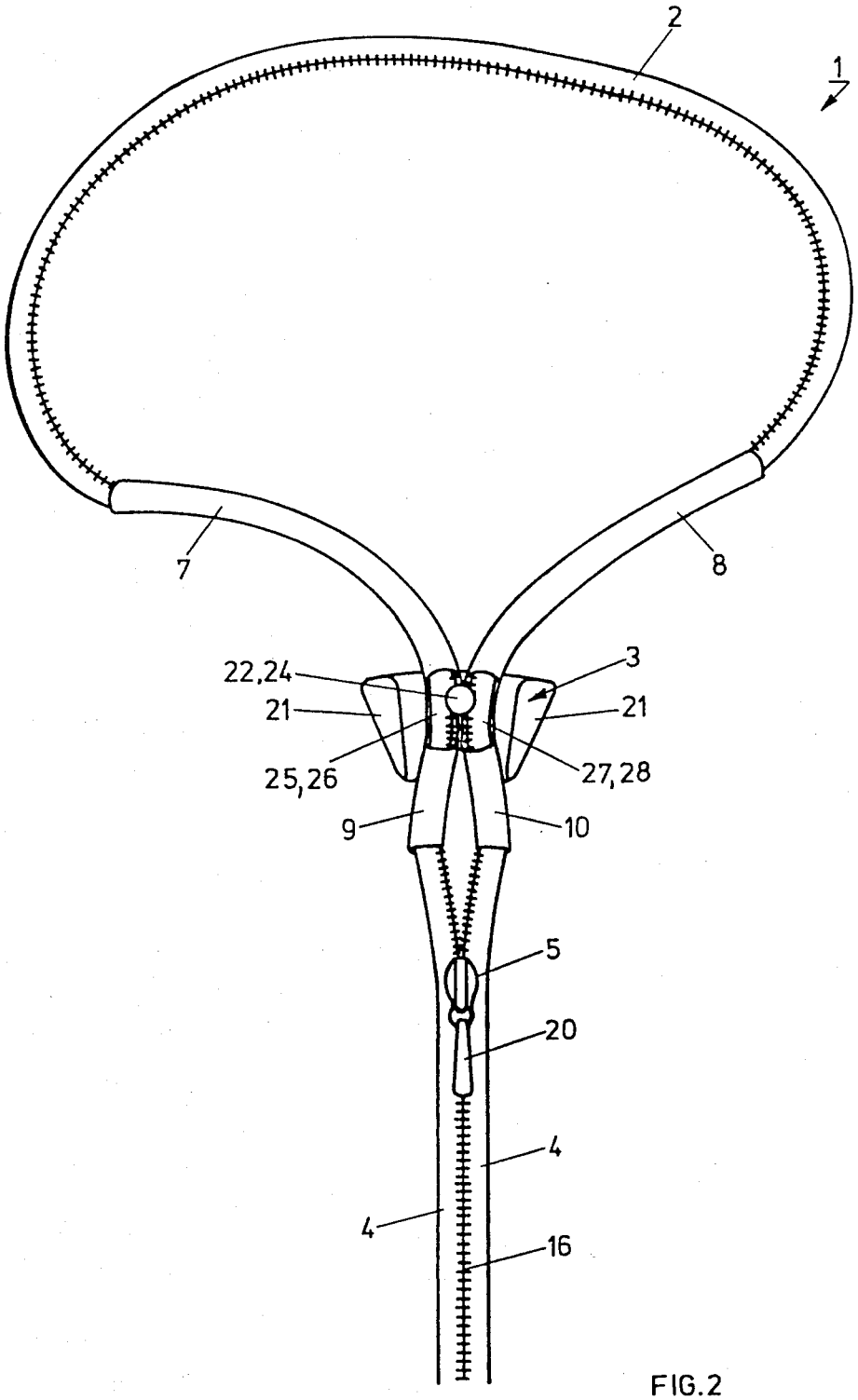
FIG. 2 is a rear view of the embodiment of FIG. 1.

FIGS. 1 and 2 show a necktie holder 1 with a neck loop 2 and a supporting and shaping member 3. The neck loop 2 is formed of one half of a continuous zipper chain or slide-fastener tape 4. After the formation of the neck loop 2, the two ends of that tape are joined together in a slide-fastener slide 5. The loop 2 is closed or opened by moving the slide so as to narrow or widen the neck loop 2.

On the front side of the supporting and shaping member 3, there is a pad 6 which normally is comprised of sponge rubber and is fastened, for instance, by adhesive, to the shaping member. Extending up from the supporting and shaping member 3, there are two plastic tubes 7 and 8 which receive the parts of the loop in the region of the shaping member 3. The tubes 7 and 8 protect the loop from jamming in the region of the shaping member. Another two plastic tubes 9 and 10 protrude downward from the shaping member 3. The two tapes of the neck loop 2 protrude from the respective ends 12 and 13 of the tubes 9 and 10. The two tapes are joined together by the slide-fastener slide 5 to form a slide fastener 16.

Around the shaping member 3 there is shown, in dot-dash line, the actual knot 15 of the necktie and the bottom part 18 of the necktie. At the top, the plastic tubes 7 and 8 are wrapped with the material of the necktie.

Figure 3:
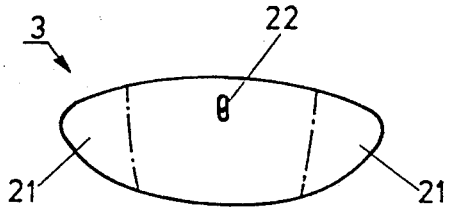
FIG. 3 is a view of the blank for the supporting and shaping member, with tab bending edges indicated in dot-dash line.

FIG. 2 shows the pull tab 20 for the slide-fastener slide 5. It also shows two shaping-member tabs 21 which, as shown in FIG. 3, form parts of the supporting and shaping member 3. Along the bending lines indicated in dot-dash lines in FIG. 3, these parts are bent inward as seen in FIG. 2, in order to form a hollow space for the passage of the slide-fastener tape 4. Furthermore, a place of attachment for the plastic tubes 7–10 is established. An opening 22 in the supporting and shaping member 3 cooperates with a holding clamp 24 in FIG. 5 to connect the tubes to the member 3. That clamp is passed through corresponding openings in the fastening tabs 25–28, which are formed after the cutting away of a part of the corresponding tubes 7–10. The holding clamp is pushed through the opening 22. After the necktie to be knotted has been received, the two free ends of the holding clamp 24 are passed through the front of the necktie and bent over. The clamp which could be in the form of a cotter pin connects the necktie front, pad, shaping member and the plastic tube together.

A plastic or metal tube of a diameter of about 5 mm and a length of about 5 to 10 mm is provided for the holding clamp. This tube protects the plate like material of the shaping member 3 from deformations caused by pressing or bulging.

Figure 4:
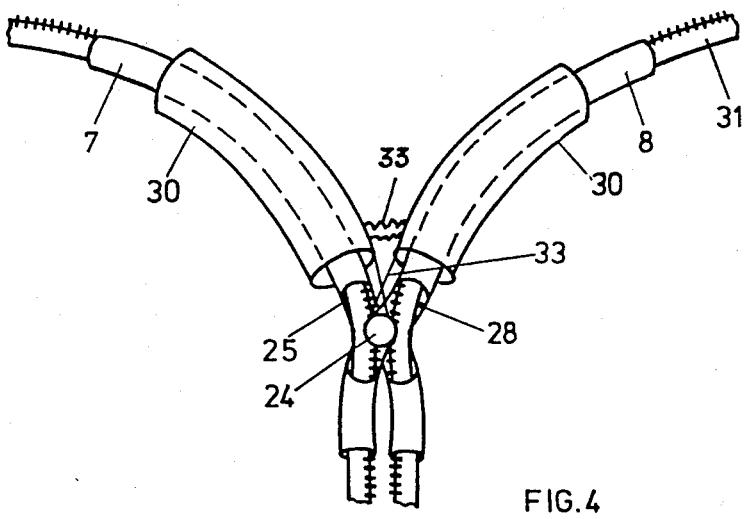
FIG. 4 shows a portion of the upper part of a necktie holder with necktie protection parts.

As can be noted in FIGS. 1 and 4, the plastic tubes 7 and 8 are provided with a covering 30 of the same material as that of the necktie. These tubes receive the endless spiral zipper or slide-fastener 31. The two tubes 7 and 8 are fastened to the shaping member 3 as explained above by means of their fastening tabs 25 and 28, which are provided with corresponding passage openings, and by the holding clamp 24. The said covering for each of the plastic tubes 7 and 8 are here further connected together by means of a connecting thread 33.

Figure 5:
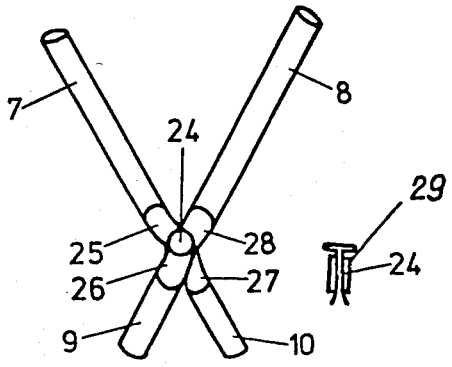
FIG. 5 shows the protective tubes for the slide-fastener tapes in the region of the supporting and shaping member.

FIGS. 5 to 8 show different embodiments of this tube construction. FIG. 5 shows a construction which can be noted from FIGS. 1 and 2, comprising four plastic tubes 7–10, which are separated from each other and which are connected to the shaping member 3 by means of their specific fastening tabs 25 and 28 and the holding clamp 24.

Figure 6:
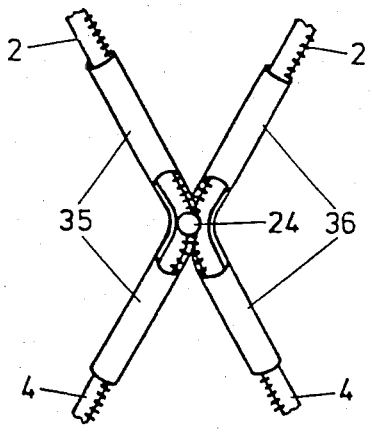
FIG. 6 is a variant of the embodiment shown in FIG. 5.
Figure 8:
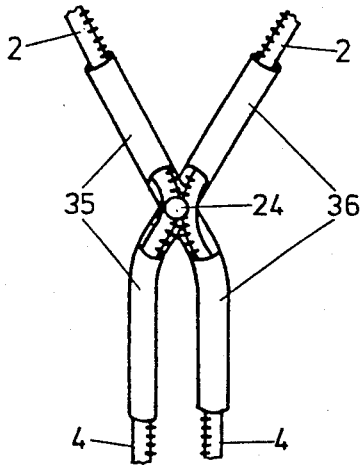
FIG. 8 is a further variant of the showing of FIG. 5.
Figure 7:
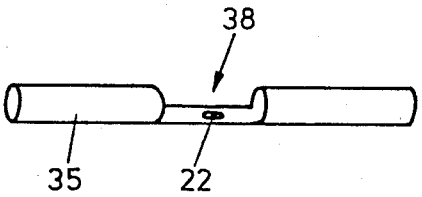
FIG. 7 shows a portion of a plastic tube.

In the embodiments in accordance with FIGS. 6 to 8, instead of four plastic tubes, there are only two plastic tubes 35 and 36, which are provided with fastening tabs or cutouts 38 in the regions of their attachments to the shaping member 3, as seen in FIG. 7. There is one opening 22 in each tube so that either in the manner shown in FIG. 6, with each tube lying alongside another, for receiving its slide-fastener tape or else, as shown in FIG. 8, the corresponding slide-fastener tape is continued upward in one tube 35 and, behind the place of attachment, in the other tube 36.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A holder for pre-tied neckties comprising a slide fastener having a slide; two slide-fastener tapes for being joined together by movement of the slide-fastener slide along the tapes; a supporting and shaping member for the necktie knot placed where the knot is to be formed;

two plastic tubes, one for each of the tapes, and one of the two slide-fastener tapes extends respectively through each of the tubes, the plastic tubes meeting at approximately a V shape toward the supporting and shaping member and being connected to the supporting and shaping member; the slide being freely movable with respect to the supporting and shaping member.

2. The holder of claim 1, further comprising a stop in the vicinity of but spaced from the supporting and shaping member for limiting the movement of the slide toward and past the supporting and shaping member.

3. A holder for pre-tied neckties comprising a slide fastener having a slide; two slide-fastener tapes for being joined together by movement of the slide-fastener slide along the tapes; a supporting and shaping member for the necktie knot placed where the knot is to be formed;

two plastic tubes, one for each of the tapes, and one of the two slide-fastener tapes extends respectively through each of the tubes, the plastic tubes meeting at approximately a V shape toward the supporting and shaping member and being connected to the supporting and shaping member; the slide being freely movable with respect to the supporting and shaping member; and a pair of second tubes, each second tube communicating with a respective one of the first-mentioned pair of tubes; the pair of second tubes extending at least approximately to the position of the slide generally at the shaping member; each one of the pair of first tubes along with a respective one of the pair of second tubes receiving one of the two slide-fastener tapes for enclosing the tapes in the regions where they extend through the tubes.

4. The holder of claim 3, wherein the tubes are plastic tubes.

5. The holder of claim 3, wherein the slide-fastener tapes extend through the shaping member down to the slide and the tubes guide the slide-fastener tapes to the uppermost position of the slide which is generally at the supporting and shaping member.

6. The holder of claim 3, wherein one of the first tubes and respective one of the second tubes are together defined by a single plastic tube, whereby a total of two plastic tubes define the entirety of the first and the second plastic tubes, and a respective tape passes through each respective single tube that defines both the first and the second tube for that tape.

7. The holder of claim 3, wherein the tubes have fastening tabs or cutouts in the region of the shaping member.

8. The holder of claim 3, wherein the tubes are fastened to the shaping member.

9. The holder of claim 8, wherein the tubes cross each other in the region of their attachment to the shaping member.

10. The holder of claim 8, wherein the tubes are arranged to define an X shape at the region of the place of attachment of the tubes to the shaping member.

11. The holder of claim 8, further comprising a supporting and spacing tube extending through the tubes where they are fastened to the shaping member.

12. The holder of claim 3, further comprising a covering a necktie material generally over a part of the first tubes near to the supporting and shaping member.

13. The holder of claim 12, wherein the coverings of necktie material on each of the tubes is connected to each other by a thread.

14. The holder of claim 3, wherein the tubes extend away from the supporting and shaping member beyond the edges thereof, both above the shaping member and below the shaping member toward the slide.

15. A holder for pre-tied neckties comprising a slide fastener having a slide; two slide-fastener tapes for being joined together by movement of the slide-fastener slide along the tapes; a supporting and shaping member for the necktie knot placed where the knot is to be formed;

two plastic tubes, one for each of the tapes, and one of the two slide-fastener tapes extends respectively through each of the tubes, the plastic tubes meeting at approximately a V shape toward the supporting and shaping member and being connected to the supporting and shaping member; the slide being freely movable with respect to the supporting amd shaping member; and a covering of necktie material generally over a part of the first tubes near to the supporting and shaping member.

16. A holder for pre-tied neckties comprising a slide fastener having a slide; two slide-fastener tapes for being joined together by movement of the slide-fastener slide along the tapes; a supporting and shaping member for the necktie knot placed where the knot is to be formed;

two plastic tubes, one for each of the tapes, and one of the two slide-fastener tapes extends respectively through each of the tubes, the plastic tubes meeting at approximately a V shape toward the supporting and shaping member and being connected to the supporting and shaping member; the slide being freely movable with respect to the supporting and shaping member; the said slide fastener comprising an endless spiral slide fastener and the tapes have respective elements of the spiral slide fastener, and the slide is for fastening the respective elements of the slide fastener together upon movement of the slide toward the supporting and shaping member.

17. A holder for pre-tied neckties comprising a slide fastener having a slide; two slide-fastener tapes for being joined together by movement of the slide-fastener slide along the tapes; a supporting and shaping member for the necktie knot placed where the knot is to be formed;

two plastic tubes, one for each of the tapes, and one of the two slide-fastener tapes extends respectively through each of the tubes, the plastic tubes meeting at approximately a V shape toward the supporting and shaping member and being connected to the supporting and shaping member; the slide being freely movable with respect to the supporting and shaping member; the two slide-fastener tapes being connected together are comprised of a single tape which is looped to define the two slide-fastener tapes to be joined.

* * * * *